US008282417B2

(12) United States Patent
Xiao

(10) Patent No.: US 8,282,417 B2
(45) Date of Patent: Oct. 9, 2012

(54) ELECTRICAL CONNECTOR WITH COOPERATING UPPER AND LOWER SHIELD WINGS

(75) Inventor: Jian-Ping Xiao, ShenZhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 18 days.

(21) Appl. No.: 12/951,097

(22) Filed: Nov. 22, 2010

(65) Prior Publication Data

US 2011/0124226 A1 May 26, 2011

(30) Foreign Application Priority Data

Nov. 20, 2009 (CN) ..... 2009 2 0315316

(51) Int. Cl.
*H01R 13/648* (2006.01)

(52) U.S. Cl. ..... 439/607.36; 439/607.56

(58) Field of Classification Search ..... 439/607.35–607.38, 607.4, 0.55, 439/0.56

See application file for complete search history.

(56) References Cited

U.S. PATENT DOCUMENTS

| | | | | |
|---|---|---|---|---|
| 6,383,024 | B1 * | 5/2002 | Wang et al. | 439/607.23 |
| 6,619,986 | B1 * | 9/2003 | Yeh | 439/607.4 |
| 7,029,331 | B1 * | 4/2006 | Lai | 439/607.35 |
| 7,549,896 | B2 * | 6/2009 | Zhang et al. | 439/607.01 |
| 7,758,379 | B2 * | 7/2010 | Chen | 439/607.11 |
| 7,997,937 | B2 * | 8/2011 | Kondo | 439/660 |

* cited by examiner

*Primary Examiner* — Hien Vu

(74) *Attorney, Agent, or Firm* — Ming Chieh Chang; Wei Te Chung

(57) ABSTRACT

An electrical connector (100) includes a dielectric housing (1) having a base portion (11) and a tongue portion (12) extending from the base portion; a number of terminals (2) received in the housing; and an upper shield (31) and a lower shield (32) enclosing the insulative housing. The upper shield includes a main cover (310) located above the insulative housing and a pair of wing portions (312) extending oppositely, laterally relative to the main cover. The lower shield includes a main plate (320) located below the insulative housing and a pair of wings (321) extending oppositely, laterally relative to the main plate. One of the wing portion and corresponding wing defines a closed slot (3122) and the other one of the wing portion and the corresponding wing integrally, interiorly fits in the closed slot.

2 Claims, 2 Drawing Sheets

ELECTRICAL CONNECTOR WITH COOPERATING UPPER AND LOWER SHIELD WINGS

BACKGROUND OF THE INVENTION

1. Field of the Invention

The present invention relates to an electrical connector, and more particularly to a low profile electrical connector including a metal shell featured with supporting tabs securely disposed onto a substrate or printed circuit board.

2. Description of the Prior Art

U.S. Pat. No. 7,549,896 issued to Hon Hai on Jun. 23, 2009 discloses a receptacle connector including a metal shield having a cover and an opposite base. The cover includes, on each side thereof, a pair of separate top lateral wings. The base includes a pair of bottom lateral wings for mating with respective top lateral wings. The top lateral wing defines a first portion of a whole lateral wing board, while the bottom lateral wing defines a second portion adapted to contribute towards completing the whole lateral wing board. Thus, the metal shield is integrated by the cover and the base, each of which is formed from a single sheet.

As can be understood, the top and the bottom lateral wings of the electrical connector disclosed in the U.S. Pat. No. 7,549,896 are processed from two metal sheets, one of the top and bottom lateral wings has a total of four legs, and the four legs might distort in punching, shipping and assembling, which makes the top and bottom lateral wings hard to maintain coplanarity and therefore difficult to be soldered with a substrate or printed circuit board.

Hence, an electrical connector with coplanar supporting wings is desired.

SUMMARY OF THE INVENTION

Accordingly, an aspect of the present invention is to provide a reliable electrical connector. The electrical connector includes a dielectric housing having a base portion and a tongue portion extending from the base portion; a number of terminals received in the housing; and an upper shield and a lower shield enclosing the insulative housing. The upper shield includes a main cover located above the insulative housing and a pair of wing portions extending oppositely, laterally relative to the main cover. The lower shield includes a main plate located below the insulative housing and a pair of wings extending oppositely, laterally from the main plate. One of the wing portion and corresponding wing defines a closed slot and the other one of the wing portion and the corresponding wing integrally, interiorly fills in the closed slot.

In a preferred embodiment, the wing portion comprises at least one dovetail groove bordering the closed slot and the wing comprises at least one lateral tab engaging into the dovetail groove.

Other objects, advantages and novel features of the invention will become more apparent from the following detailed description when taken in conjunction with the accompanying drawings.

DESCRIPTION OF PREFERRED EMBODIMENT OF THE INVENTION

Reference will now be made to the drawings to describe the present invention in detail.

Figure 1:
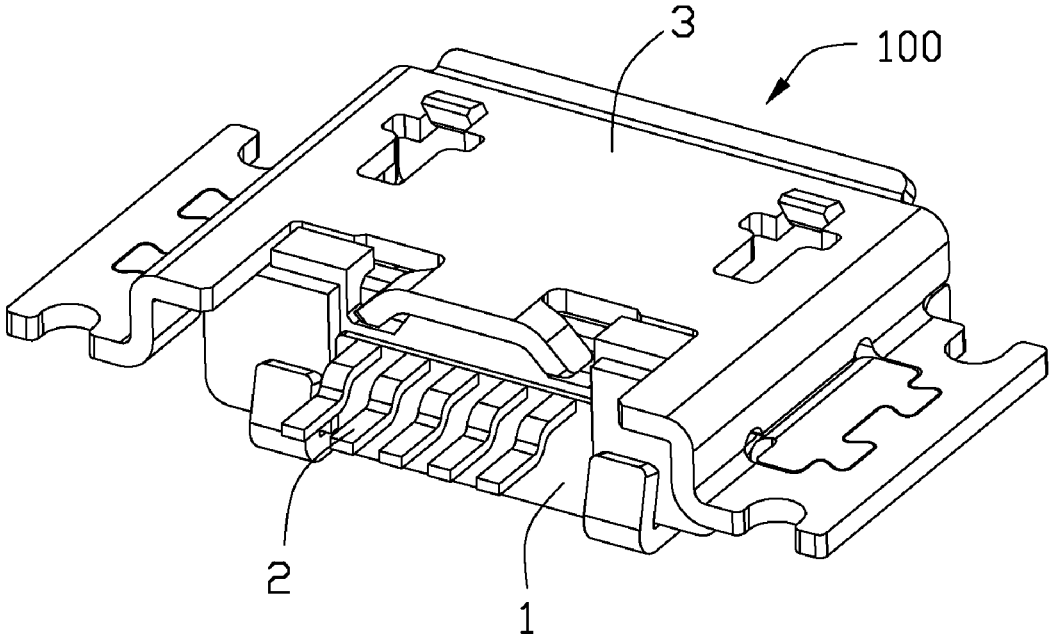
FIG. 1 is a perspective view of an electrical connector in accordance with a preferred embodiment of the present invention.

Referring to FIG. 1, depicting an embodiment of an electrical connector 100, the connector is installed on a substrate, for example a print circuit board (PCB) or the like.

The electrical connector 100 includes a dielectric housing 1, a plurality of terminals 2 received in the housing 1, and a metal shield 3 enclosing the dielectric housing 1.

Figure 2:
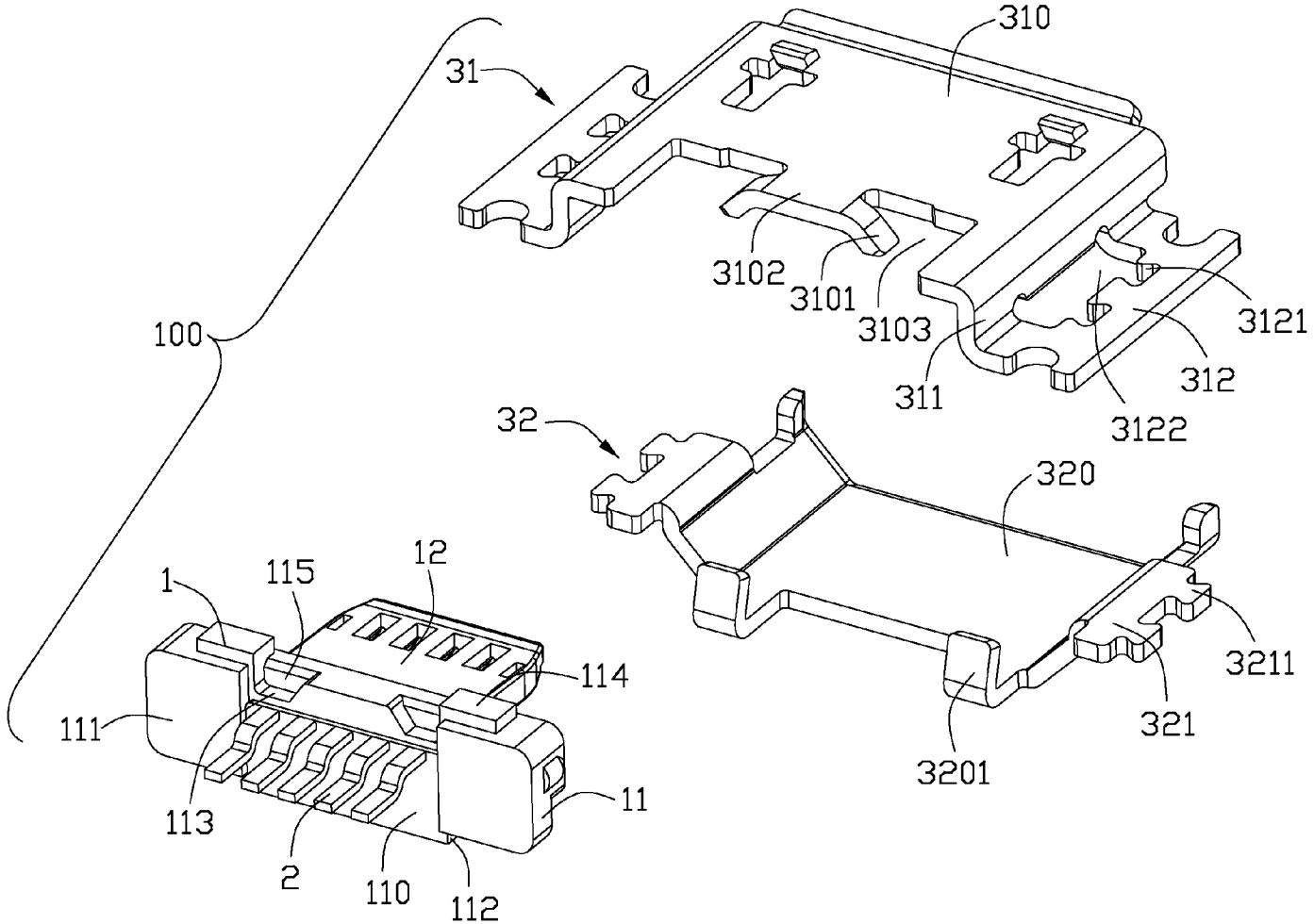
FIG. 2 is an exploded view of FIG. 1.

Elements of electrical connector 100 are shown clearly in FIG. 2. The dielectric housing 1 contains a base portion 11 and a tongue portion 12 extending from the base portion 11. The base portion 11 comprises a middle part 110 and two side parts 111 on the two sides of the middle part 110 separately. A pair of blocks 114 project from the top face of the side parts 111 of the base portion 11, a pair of concaves 113 are located between the blocks 114 and formed on the middle part 110 and a front wall 115 is formed therein, and a protruding portion 112 is disposed at a middle bottom face of the base portion 11. The tongue portion 12 extends from the front face of the base portion 11. Each terminal 2 extends in the base portion 11 and the tongue portion 12, and the tail portion of the terminal 2 extend beyond the base portion 11 for terminating to a substrate.

The metal shield 3 has two parts, namely an upper shield 31 and a lower shield 32 opposite to the upper shield 31. Both of the upper shield 31 and the lower shield 32 are formed by processing metal sheet. The upper shield 31 has a main cover 310, a pair of vertical walls 311, and lateral wing portions 312 parallel with the main cover 310 and extending from the lateral walls 311. Each lateral wing portion 312 has a closed slot 3122 and at least one dovetail groove 3121 bordering the closed slot 3122. The lateral wing portions 312 surround the closed slot 3122, and the front and the rear sides of the lateral wing portions 312 connect with each other from outside. A gap 3103 is mounted on the rear end of the main cover 310; a holding portion 3102 is located in the middle of the gap 3103. The holding portion 3102 contains two fingers 3101. The fingers 3101 and the gap 3103 form a space receiving the blocks 114 therein. The lower shield 32 has a main plate 320, and a pair of wings 321 extending from the end of the main plate 320. Each wing 321 has a dovetail-shaped lateral tab 3211 having an external contour corresponding to the dovetail grooves 3121. And the lateral wing portion 312 and the wing 321 can match together, with the wings 321 received in the closed slots 3122 along a vertical direction perpendicular to the mating direction. The lateral tab 3211 is enclosed by the dovetail groove 3121 so as to be embedded within the closed slot 3122. The main plate 320 has two arms 3201 in the rear end of the main plate 320. And tail portions of the terminals 2 are coplanar with the wings 312, 321. The wing portions 312 extend downwardly from the main cover 310 and the wings 321 extending upwardly from the main plate 320 such that the wing portions 312 and the wings 321 are positioned at a middle level relative to the main cover 310 and the main plate 320.

The blocks 114 of the dielectric housing 1 are received in the spaces formed by edge of the gap 3103 and the fingers 3101 of the holding portion 3102, the fingers 3101 of the holding portion 3102 correspondingly fixed to the concaves 113 beside the blocks 114, and the fingers 3101 press on the front wall 115 of the concave 113. The inside face of the arms 3201 lean against the two sides of the outside face of the protrude portion 112, and the end of the arms 3201 lean against the rear face of the side part 111 of the base portion 11. The arms 3201 and the fingers 3101 are in pairs and arranged in symmetry making the dielectric housing 1 in stabilized state.

The metal shield 3 contains separate upper shield 31 and lower shield 32, both the upper shield 31 and bottom shield 32 are shaped in one press processing, and the processing can increase the productivity of the metal shield 3 and make the assembling more convenient.

As shown in FIG. 1, the lateral wing portion 312 defines a first portion of a whole lateral wing board with a closed slot, while the wing defines a second portion to complete the whole lateral wing board. Thus, the metal shield 3 is integrated by the upper shield and the lower shield. The front and the rear sides of the wing portions of the upper shield connect with each other at outside to form an integrated plate to strengthen itself to avoid damage.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector comprising:

a dielectric housing having a base portion and a tongue portion extending from the base portion;

a plurality of terminals received in the housing; and an upper conductive shield and a lower conductive shield enclosing the housing each having sidewalls, the upper shield comprising a main cover located above the housing and a pair of wing portions extending oppositely, laterally relative to the main cover, the lower shield comprising a main plate located below the housing and a pair of wings extending oppositely, laterally from the main plate, each of the wing portions defining an interior closed slot and each of the other one of the wings with surround edges being filled in the interior closed slot;

wherein each of the wing portions comprises a pair of dovetail grooves extending perpendicularly to the sidewalls of the upper shield and inside of the interior closed slot and the wing comprises a pair of dovetail tabs extending perpendicularly to the sidewalls of the lower shield and engaging into the dovetail grooves; and wherein the terminals comprise respective tail portions extending outside of the housing and the tail portions are coplanar with the wing portions and the wings.

2. The electrical connector as claimed in claim 1, wherein the wing portions and the wings are positioned at a middle level relative to the main cover and the main plate.

* * * * *